US007690752B2

(12) United States Patent
King et al.

(10) Patent No.: US 7,690,752 B2
(45) Date of Patent: Apr. 6, 2010

(54) METHODS AND APPARATUS FOR OPTIMIZING ENERGY SUPPLIED TO A PRINT HEAD HEATER

(75) Inventors: David Golman King, Shelbyville, KY (US); Jason Todd McReynolds, Georgetown, KY (US); Prabuddha Jyotindra Mehta, Lexington, KY (US); Robert Henry Muyskens, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 298 days.

(21) Appl. No.: 11/960,838

(22) Filed: Dec. 20, 2007

(65) Prior Publication Data

US 2009/0160893 A1 Jun. 25, 2009

(51) Int. Cl.
*B41J 29/393* (2006.01)

(52) U.S. Cl. ..... 347/19

(58) Field of Classification Search ..... 347/19, 347/9–11, 14

See application file for complete search history.

(56) References Cited

U.S. PATENT DOCUMENTS 7,357,487 B2 * 4/2008 Kusunoki ..... 347/54
7,377,632 B2 * 5/2008 Kachi ..... 347/102
7,410,233 B2 * 8/2008 Kitami et al. ..... 347/11

* cited by examiner

*Primary Examiner*—Lamson D Nguyen

(57) ABSTRACT

Methods and apparatuses for optimizing the energy supplied to a print head heater are disclosed. A resistance associated with the print head heater or actuator is determined. A range of fire pulse values is determined based at least in part on the determined resistance and a velocity optimization procedure is executed based at least in part on the determined range of fire pulse values. An optimal fire pulse for the print head heater is selected based at least in part on the results of the velocity optimization procedure.

20 Claims, 7 Drawing Sheets

METHODS AND APPARATUS FOR OPTIMIZING ENERGY SUPPLIED TO A PRINT HEAD HEATER

FIELD OF THE INVENTION

The invention relates generally to printer heads, and, more particularly, to methods and apparatus for optimizing energy supplied to a print head heater.

BACKGROUND OF THE INVENTION

A number of printers, copiers, and multi-function products may utilize at least one print head that is fluidly coupled to an ink supply. Such a print head typically includes a plurality of nozzles having corresponding ink ejection actuators, such as heater elements.

A print head can typically be carried across a print medium while the ink droplets are discharged onto selected pixel locations. Ink droplets are typically discharged from the nozzles onto a print medium by actuating associated heater elements or heaters. A fire pulse is typically supplied to a heater for a period of time in order to discharge an ink droplet from a nozzle. An approximate amount of desired energy for properly ejecting an ink droplet is typically associated with a print head heater. This approximate energy is provided by supplying a fire pulse over a period of time.

The manufacture of print heads may involve certain manufacturing tolerances resulting in manufacturing variation, including variations in the sheet resistance of the material used in heater elements, mask alignment variations, variations in the rise and fall times of transistors that drive the heater elements, and variations in the voltage level of a power source. These manufacturing variations and other variables often affect the period of time that the fire pulse should be supplied in order to properly eject an ink droplet.

Conventional systems may attempt to optimize the energy sent to a print head heater by repeatedly printing a pattern using different fire pulses and then scanning the pattern to determine which of the fire pulses will deliver the optimal energy to the print head nozzles. These conventional systems, however, may often test a broad range of potential fire pulses that take into account the numerous manufacturing variations that are applicable to any given print head. Such testing typically utilizes a relatively large amount of ink in initializing a print head. Additionally, given the broad range of potential fire pulses that are examined, the conventional testing may not identify an optimum fire pulse with a high degree of accuracy.

Accordingly, there is a need for systems and apparatus for optimizing energy supplied to a print head heater.

SUMMARY OF THE INVENTION

According to one embodiment of the invention, there is provided a method for optimizing the fire energy supplied to an actuator of a print head. A resistance associated with the actuator is determined and one or more fire pulse values are determined based at least in part on the determined resistance. A velocity optimization procedure is executed based at least in part on the determined one or more fire pulse values and an optimal fire pulse is selected for the actuator based at least in part on an output associated with the velocity optimization procedure. The selected optimal fire pulse may optimize the fire energy supplied to the actuator.

According to another embodiment of the invention, there is provided a system for optimizing a fire pulse supplied to an actuator of a print head. The system may include a resistance measuring device and at least one controller. The resistance measuring device may be operable to determine a resistance associated with the actuator. The at least one controller may be operable to determine one or more fire pulse values based at least in part on the determined resistance, facilitate the execution of a velocity optimization procedure based at least in part on the determined one or more fire pulse values, and select an optimal fire pulse for the actuator based at least in part on an output associated with the velocity optimization procedure.

According to another embodiment of the invention, there is provided a system for optimizing a fire pulse supplied to an actuator of a print bead. The system may include at least one memory device and a controller. The at least one memory device may be operable to store a resistance value associated with the actuator. The at least one controller may be operable to receive the resistance value from the at least one memory device, determine one or more fire pulse values based at least in part on the determined resistance, facilitate execution of a velocity optimization procedure based at least in part on the determined one or more fire pulse values, and select an optimal fire pulse for the actuator based at least in part on an output associated with the velocity optimization procedure.

According to yet another embodiment of the invention, there is provided a print head with a plurality of nozzles and a plurality of associated actuators, wherein the activation of at least one of the plurality of actuators facilitates ejection of ink from at least one of the plurality of nozzles. A resistance associated with the at least one actuator is determined and one or more fire pulse values is determined based at least in part on the determined resistance. A velocity optimization procedure is executed for the print head based at least in part on the determined one or more fire pulse values for use in selection of an optimal fire pulse for the at least one actuator.

According to yet another embodiment of the invention, there is provided an imaging device. The imaging device may include a print head, a resistance measuring device, and at least one controller. The print head may include a plurality of nozzles and a plurality of associated actuators, wherein the activation of at least one of the plurality of actuators facilitates ejection of ink from at least one of the plurality of nozzles. The resistance measuring device may be operable to measure a resistance associated with at least one actuator. The at least one controller may be operable to receive the measured resistance from the resistance measuring device, determine one or more fire pulse values based at least in part on the received resistance, facilitate the execution of a velocity optimization procedure for the print head based at least in part on the determined one or more fire pulse values, and select an optimal fire pulse value for the at least one actuator based at least in part on an output associated with the velocity optimization procedure.

Other embodiments, objects, features and advantages of the invention will become apparent to those skilled in the art from the detailed description, the accompanying drawings and the appended claims.

BRIEF DESCRIPTION OF THE DRAWINGS

Figure 1:
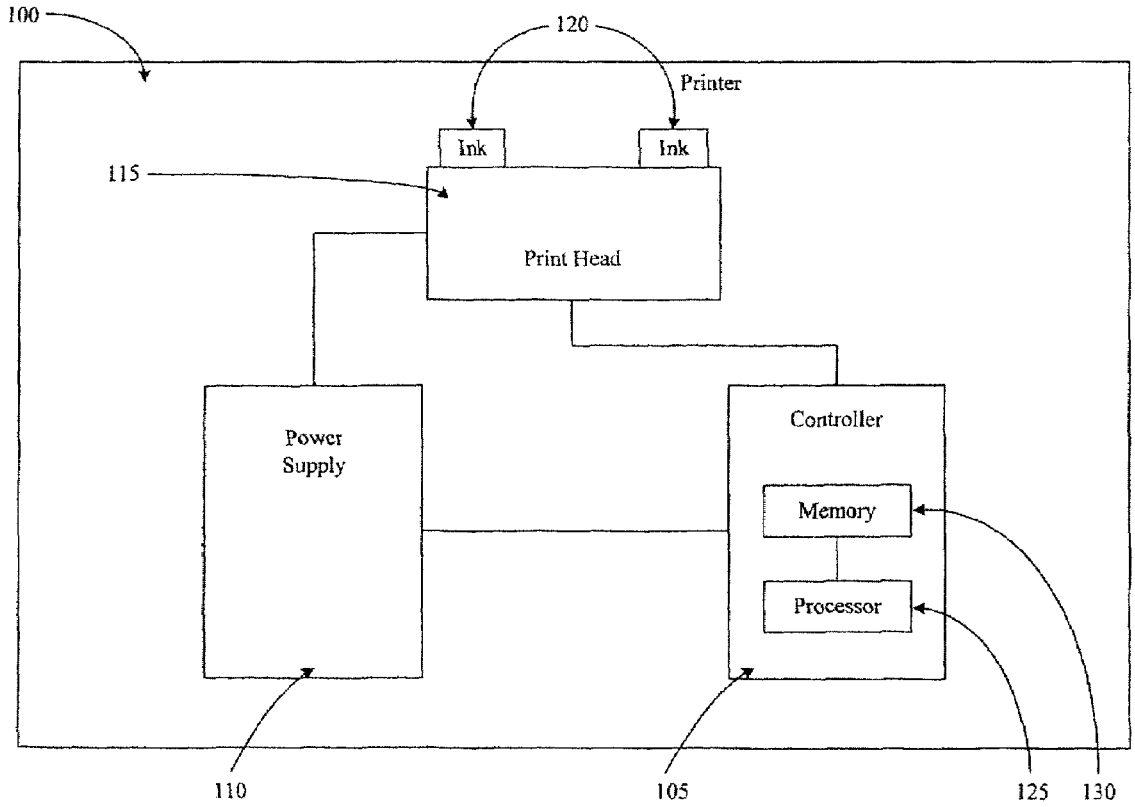

Having thus described the invention in general terms, reference will now be made to the accompanying drawings, which are not necessarily drawn to scale, and wherein:

FIG. 1 is a block diagram of one example of a printer in which a fire pulse may be optimized, according to an illustrative embodiment of the invention.

Figure 2:
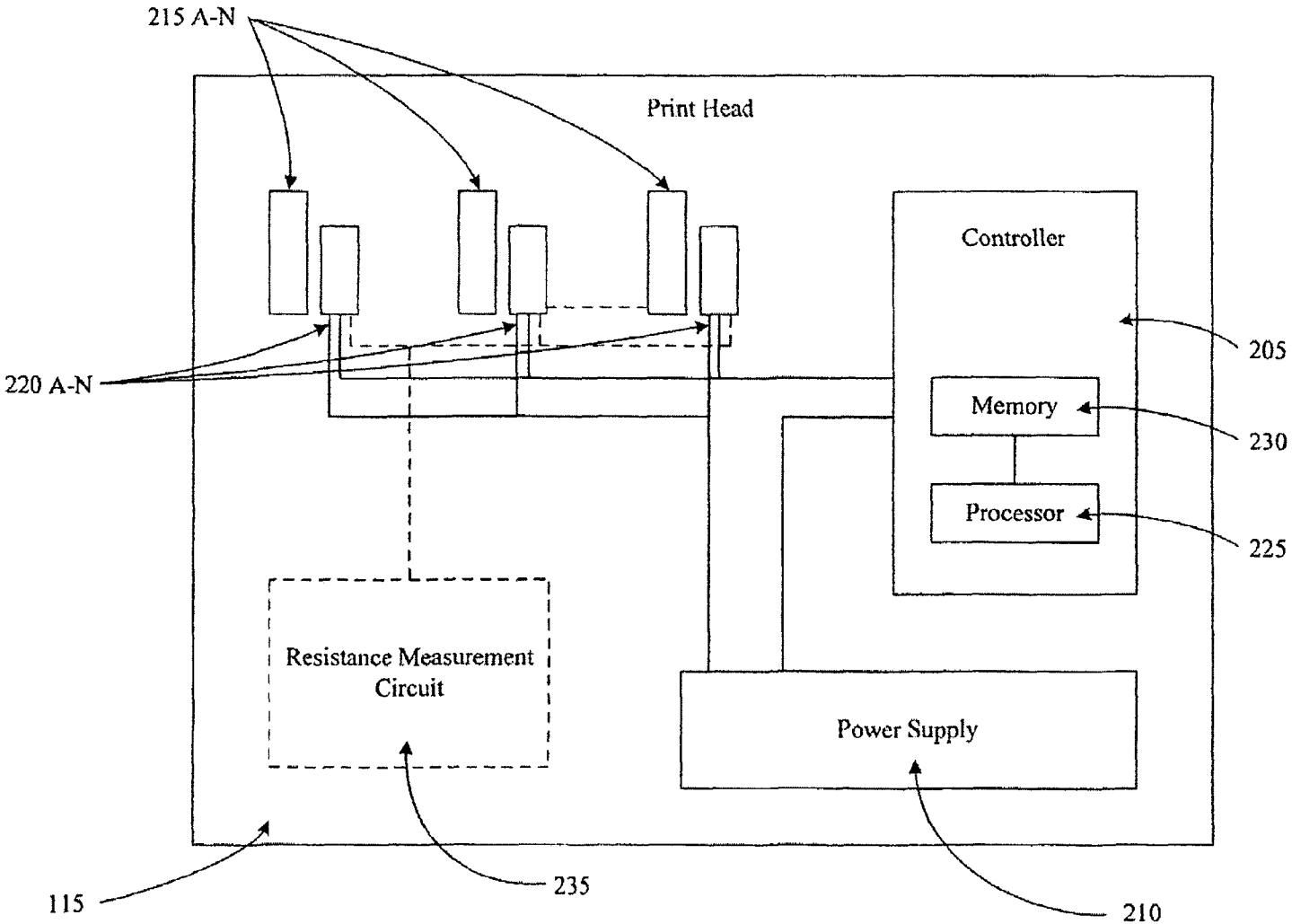

FIG. 2 is a block diagram of one example of a print head, according to an illustrative embodiment of the invention.

Figure 3:
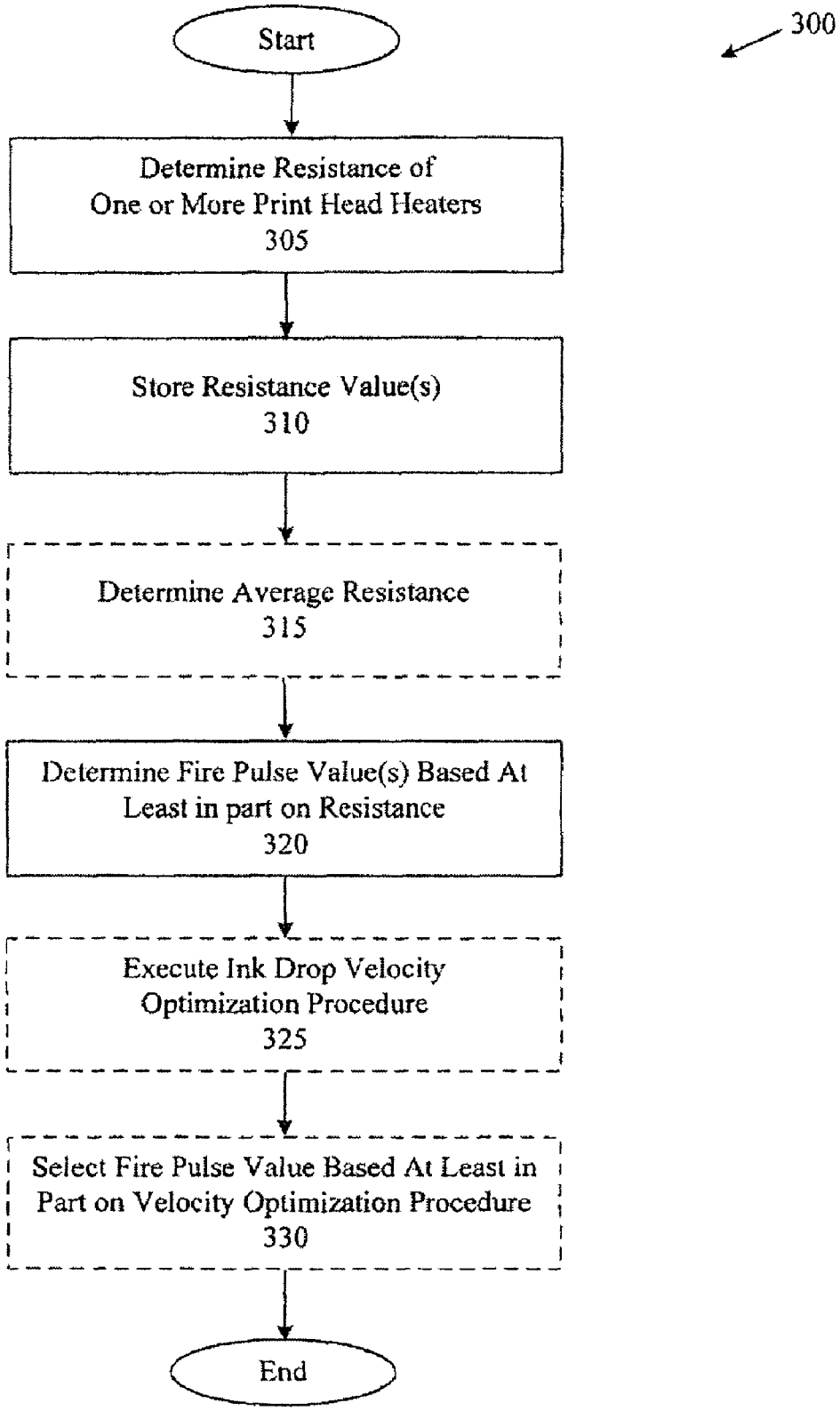

FIG. 3 is a flowchart of a method for determining an optimum fire pulse value, according to an illustrative embodiment of the invention.

Figure 4:
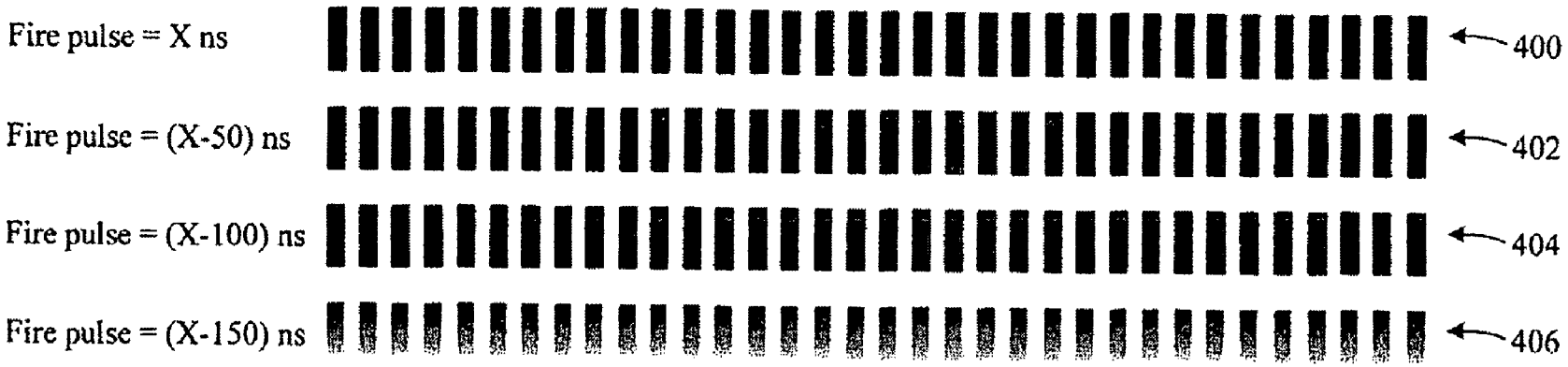

FIG. 4 is an example of the output of an ink droplet velocity optimization procedure, according to an illustrative embodiment of the invention.

Figure 5A:
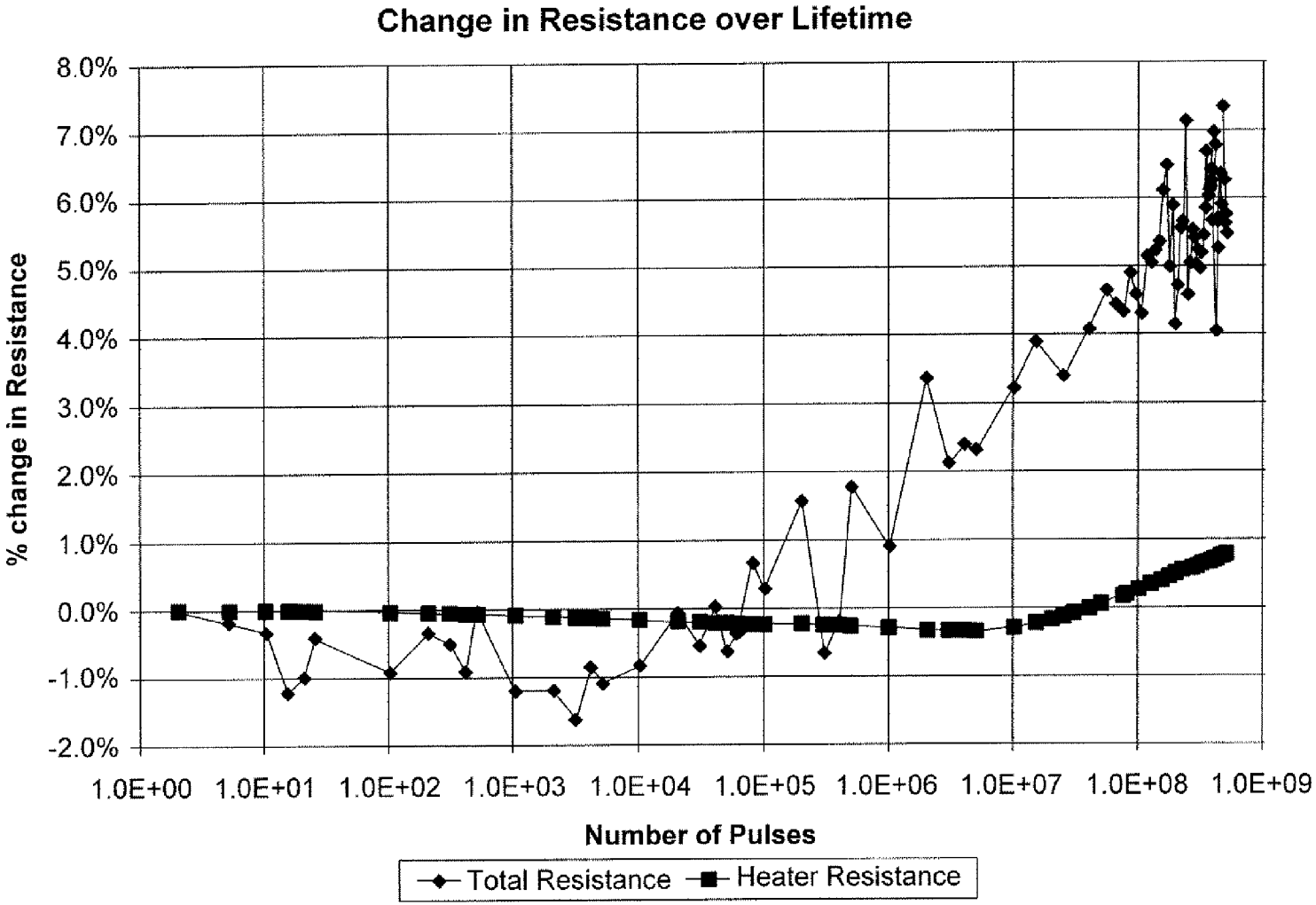
Figure 5B:
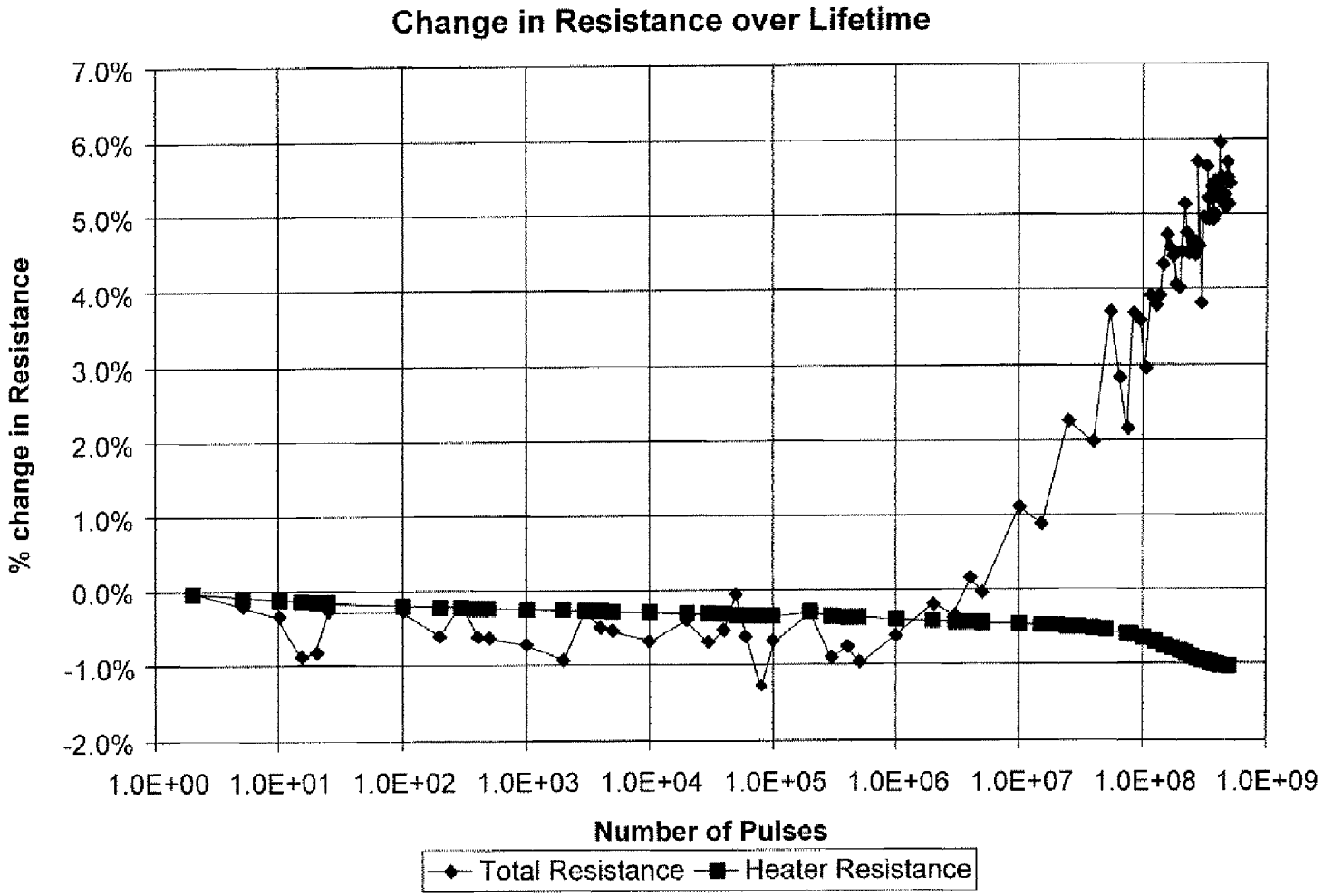

FIGS. 5A and 5B are charts that illustrate examples of changes in the resistance of print head heater elements over the lifetime of the print head.

Figure 6:
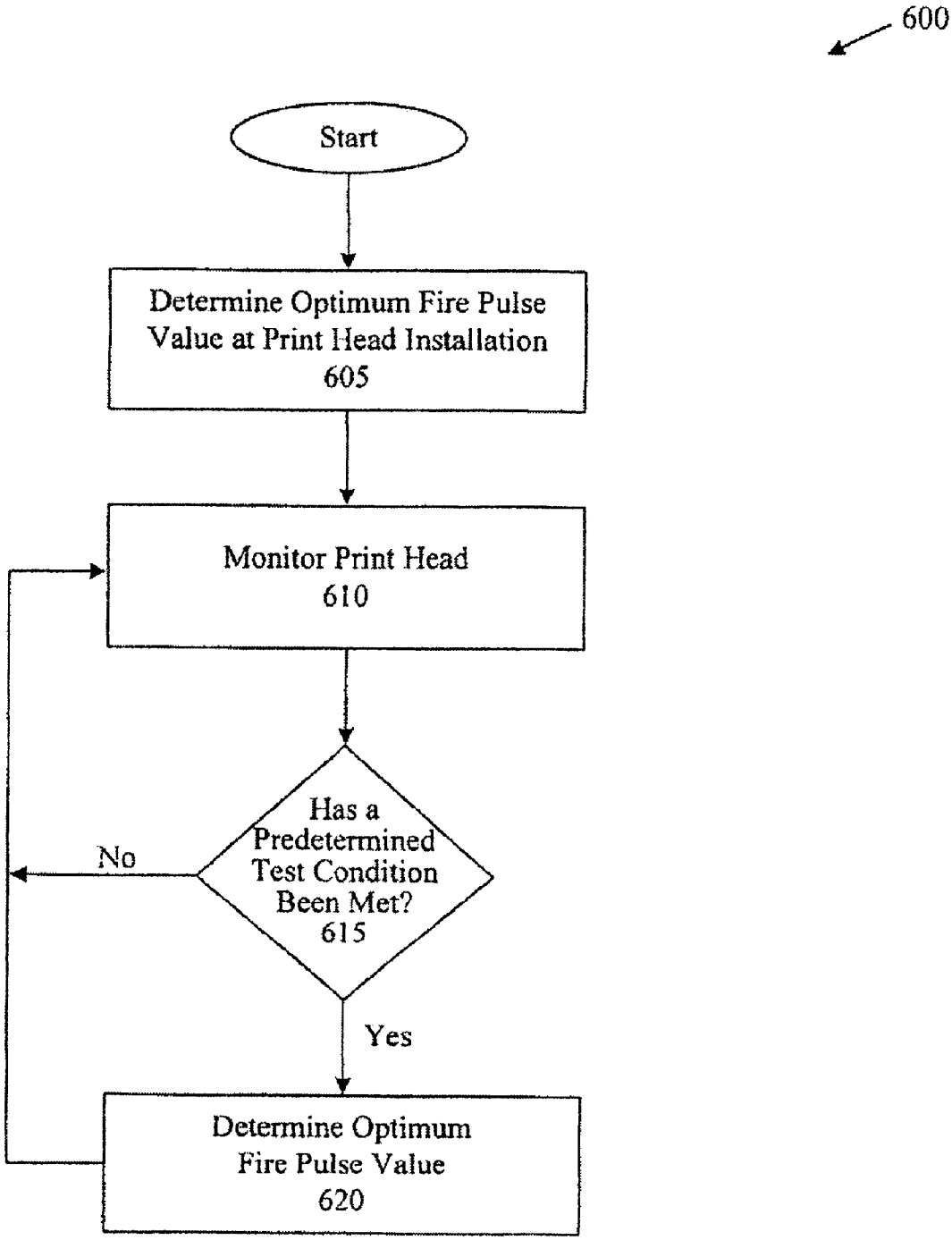

FIG. 6 is a flowchart of a method for adjusting the optimum fire pulse value over the course of the lifetime of the print head, accordance to an illustrative embodiment of the invention.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF EMBODIMENTS OF THE INVENTION

Embodiments of the invention will now be described more fully hereinafter with reference to the accompanying drawings. Indeed, the invention may be embodied in many different forms and should not be construed as limited to the embodiments set forth herein; rather, these embodiments are provided so that this disclosure will satisfy applicable legal requirements. Like numbers refer to like elements throughout.

Embodiments of the invention are described below with reference to block diagrams of systems, methods, apparatuses and computer program products according to embodiments of the invention. It will be understood that each block of the block diagrams, and combinations of blocks in the block diagrams, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functionality of each block of the block diagrams, or combinations of blocks in the block diagrams discussed in detail in the descriptions below.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the block or blocks.

Accordingly, blocks of the block diagrams support combinations of means for performing the specified functions, combinations of steps for performing the specified functions and program instruction means for performing the specified functions. It will also be understood that each block of the block diagrams, and combinations of blocks in the block diagrams, can be implemented by special purpose hardware-based computer systems that perform the specified functions or steps, or combinations of special purpose hardware and computer instructions.

Disclosed are methods and apparatus for optimizing the energy that is supplied to a print head heater. Optimizing the energy that is supplied to a print head's heaters may facilitate the proper ejection of ink from associated nozzles of the print head. The energy supplied to a print head's heaters is optimized based at least in part on a resistance associated with the heaters of the print head. A heater resistance is determined, and the heater resistance may be utilized in conjunction with an ink droplet velocity optimization system or procedure to determine the fire pulse that will be supplied to the heaters. Additionally, in accordance with certain embodiments of the invention, the fire pulse may be reconfigured or adjusted during the lifespan of the print head.

Turning to the figures, FIG. 1 depicts a block diagram of one example of a printer 100 in which a fire pulse may be optimized, according to an illustrative embodiment of the invention. It will be appreciated that a fire pulse may be optimized in accordance with various embodiments of the invention for a wide variety of printers, copiers, multi-function products, and other printing devices. The optimization of a fire pulse in accordance with embodiments of the invention is not limited to the printer 100 depicted in FIG. 1.

With reference to FIG. 1, a printer 100 may include at least a printer controller 105, a printer power supply 110, and a print head 115. The printer controller 105 may control the operation of the printer 100. The printer controller 105 may include, for example, a processor 125 and associated memory 130 for controlling the operation of the printer 100. The printer controller 105 may be in communication with one or more other components of the printer 100 via any number of suitable communication links such as, for example, wired connections and/or wireless connections. The printer controller 105 may additionally be in communication with one or more external components such as, for example, a computer, a digital camera, a personal digital assistant, and/or a portable memory device. It will be appreciated that the printer controller 105 may be in communication with the one or more external components via any number of suitable connections, ports, and/or communication links.

The printer power supply 110 may provide power to one or more other components of the printer 100 such as, for example, the printer controller 105 and/or the print head 115. The printer power supply 110 may be coupled to a power source such as, for example, to a standard electrical outlet. Additionally, the printer power supply 110 may include one or more suitable power transformers that receive a power signal from the standard electrical outlet (e.g., a 120 VAC signal) and transform the power signal into a suitable printer power signal such as, for example, a low voltage direct current power signal.

The print head 115 may be fluidly coupled to one or more ink supplies 120 such as, for example, a black ink supply and/or one or more color ink supplies. The print head 115 may receive ink from the one or more ink supplies 120 and discharge the ink onto selected pixel locations of a print medium via a plurality of nozzles, such as nozzles 215A-N shown in FIG. 2.

The print head 115 may be coupled to a carrier system (not shown) that is configured for unidirectional and/or bi-directional printing. The carrier system may transport the print head 115 across the print media at the direction of the printer controller 105 to facilitate the discharge of ink onto the print medium. The printer controller 105 may direct the print head 115 to discharge the ink onto selected pixel locations of the print medium.

It will be understood that the printer 100 may include any number of print heads such as, for example, a black print head and one or more color print heads. Each of the print heads may be fluidly coupled to any number of ink supplies, such as 120. Alternatively, the printer 100 may include a single print head 115 that is fluidly coupled to one or more ink supplies, such as 120.

FIG. 2 is a block diagram of one example of a print head, such as print head 115, according to an illustrative embodiment of the invention. A print head 115 may include a print head controller 205, a print head power supply 210, a plurality of nozzles 215A-N, and a plurality of ink actuation elements, such as heaters 220A-N. In one embodiment, a print head 115 may include a resistance measurement circuit 235. A resistance measurement circuit may include any suitable resistance measuring device, technique, circuit, and/or logic.

The print head controller 205 may control the operation of the print head 115. The print head controller 205 may include, for example, a processor 225 and associated memory 230 for controlling the operation of the print head 115. The memory 230 of the print head controller 205 may store various parameters, variables, and/or other information that is utilized during the initialization and/or the operation of the print head 115. The print head controller 205 may be in communication with one or more other components of the print head 115 via any number of suitable communication links such as, for example, wired connections and/or wireless connections. The print head controller 115 may additionally be in communication with the printer controller 105 and/or one or more external components such as, for example, a computer, a digital camera, a personal digital assistant, and/or a portable memory device via any number of suitable connections, ports, and/or communication links.

It will be appreciated that a print head may include any number of print head controllers. Although not illustrated, one of ordinary skill will readily understand that typically a controller is not part of the print head, and the operation is instead handled by a controller located on the printer (e.g., printer controller 105). The present invention is equally advantageous regardless of whether the controller(s) that handles the processing is located on the printer, the print head or some other external device.

The print head power supply 210 may provide a power signal to one or more of the other components of the print head 115. The print head power supply 210 may receive a power signal from an appropriate source such as, for example, printer power supply 110. It will be understood that the print head power supply 210 may transform the source signal prior to supplying power to another component of the print head 115. For example, the print head power supply 210 may regulate, limit, and/or step down a source signal as desired in embodiments of the invention. Additionally or alternatively, one or more of the components of the print head 115 may receive a power signal from a power supply that is external to the print head 115 such as, for example, the printer power supply 110. Again, one of ordinary skill in the art will readily understand that most print heads do not require a separate power source and rely instead on the printer's power source. The present invention is equally advantageous regardless of whether the power supply is located on the print head, the printer, or elsewhere.

The nozzles 215A-N may be individually selectable nozzles that are configured to eject or discharge ink supplied by suitable ink supplies, such as ink supplies 120, onto a print medium. One or more actuators, such as heaters 220A-N, may be associated with a respective nozzle 215A-N. As used herein, the terms "heater," "print head heater," "print head actuator," and "actuator" may be used interchangeably. In order to discharge ink from a nozzle, such as nozzle 215A, a fire pulse may be supplied to an associated heater, such as heater 220A. The print head controller 205 may control the supply of a fire pulse to a heater in order to control the discharge of ink from a nozzle. It will be appreciated that a print head may include any number of nozzles and/or heaters.

As used herein, the term "fire energy" may refer to the total amount of energy (in joules, for example) supplied by a power signal to an actuator, such as heater 220A, to discharge or jet a droplet of ink. Fire energy may be adjusted, for example, by adjusting a duration of a pre-fire and/or a fire pulse of a power signal supplied to the heater 220A. Given a relatively constant power signal, a fire pulse of a relatively brief duration may supply less total energy to a heater 220A than a fire pulse with a relatively longer pulse duration. According to an embodiment of the invention, an optimal fire pulse may be determined that may achieve a suitable ink droplet discharge with a minimal amount of energy.

A wide variety of manufacturing variations and other factors may affect the optimal amount of energy and, therefore, the duration of a fire pulse supplied to a heater, such as 220A, to optimally discharge ink from a nozzle, such as 215A. One factor that may affect the fire pulse duration is the resistance associated with one or more of the print head heaters 220A-N.

A single layer, or sheet of resistive material is typically utilized during the manufacture of a print head, such as 115. The resistive material may be masked and/or etched during the manufacture of the print head 115, and the various heaters may be formed on the layer of resistive material. Given a single layer of resistive material in a print head, such as 115, a relatively constant or consistent resistance may be associated with each of the heaters 220A-N of the print head 115. Although a single layer of resistive material is typically utilized in the manufacture of a print head, it will be appreciated that embodiments of the invention may be utilized with a print head that is manufactured utilizing a plurality of resistive layers and/or types of resistive materials.

It will be appreciated that a wide variety of resistive materials may be utilized during the manufacture of a print head, such as 115. Examples of resistive materials that may be utilized include, but are not limited to, tantalum aluminum, tantalum aluminum nitride, tantalum silicon nitride, tungsten silicon nitride, and/or tantalum silicon carbide. Additionally, it will be appreciated that a wide range of resistive layer thicknesses may be utilized in a print head 115. Due to the wide range of materials and thicknesses, different print heads may have a wide range of resistances associated with their heaters. Additionally, there may be variations in heater resistance across the various heaters of a print head. Current printers are typically designed to accommodate print heads with a wide range of heater resistance values. Printers may include a heater inspection string with a group of heaters connected in series. The heater inspection string may be utilized in order to test the print head during a quality control check. Given a typical heater inspection string of five heaters, the combined heater resistance values of the inspection string may range, for example, from approximately 583.5 ohms to approximately 789.5 ohms with a tolerance of approximately plus or minus 8 percent. Individual heater resistances may be assumed to follow similar percentage variation trends.

By utilizing a basic Ohm's law analysis, the effect of variations in heater resistance on the power supplied to a heater may be illustrated. The power supplied to a heater may be given by equation (1) below:

$$P = \frac{V^2}{R} \tag{1}$$

where "P" represents power, "V" represents voltage, and "R" represents resistance. In other words, assuming a relatively constant voltage supplied to a heater, the power supplied to the heater is inversely proportional to the heater resistance. Additionally, power may also be represented by equation (2) as:

$$P = \frac{E}{t} \tag{2}$$

wherein "P" represents power, "E" represents energy, and "t" represents time. A heater, such as heater 220A, may have an ejection energy associated with the ejection of an ink droplet. The ejection energy may be the approximate minimum amount of energy supplied to the heater in order to suitably eject the ink droplet. The ejection energy may be a known value for any given heater and nozzle combination, such as 220A and 215A. Given a known ejection energy and a value for power supplied to a heater, the time "t" may be determined. The time "t" may represent the approximate duration or length of time for an optimal fire pulse that should be supplied to the heater 220A in order to suitably eject an ink droplet from the associated nozzle 215A.

According to various embodiments of the invention, the fire pulse may be optimized based at least in part on the resistance of one or more print head heaters, such as heaters 220A-N. In other words, measuring or determining the resistance of one or more print head heaters 220A-N may facilitate improving a print head energy management system. For example, if the heaters have a relatively high resistance, then the power supplied to the heaters by a power signal will be decreased and a fire pulse with a longer duration may be utilized to suitably eject an ink droplet.

FIG. 3 depicts a flowchart of a method 300 for determining an optimum fire pulse value, according to an illustrative embodiment of the invention. The method 300 begins at block 305. At block 305, the individual and/or collective resistance of one or more print head heaters, such as heaters 220A-N may be determined. The resistance of the one or more heaters, such as 220A-N, may be determined by any suitable resistance measurement technique, device, or circuit and/or associated control logic. One or more suitable resistance measuring devices or circuits may be included as a component of a print head, such as print head 115, may be included as a component of a printer, such as printer 100, and/or may be external to the printer 100. For example, as shown as an optional component in FIG. 2, a resistance measuring circuit 235 may be included as a component of the print head 115. As another example, a suitable resistance measuring device or circuit may be included as a component of the printer 100. As yet another example, an external resistance measuring device or circuit may be utilized in a determination of the resistance of one or more print head heaters, such as 220A-N. Examples of utilizing a resistance measuring device that is external to the print head and printer may include utilizing an external resistance measuring device during the manufacture and/or quality control testing of a print head. That is, the resistance of one or more heaters may be measured prior to or during the print head being installed in a printer or other device.

It will be appreciated that a wide variety of resistance measuring devices, resistance measuring circuits, and/or resistance measurement techniques may be utilized in accordance with embodiments of the invention. Examples of suitable devices and methods for measuring heater resistance may include, but are not limited to, ohmmeters, resistance meters, voltage divider circuits, analog-to-digital converters, voltage-to-current converters, voltage drop circuits, and quantum Hall effect circuits.

The resistance of any number of heaters, such as heaters 220A-N, may be measured in accordance with various embodiments of the invention. According to one embodiment of the invention, resistances may be measured for a predetermined number of test heaters or inspection heaters. For example, a print head, such as 115, may include a heater inspection string with a predetermined number of test heaters connected in series. It will be appreciated that the inspection string may include any number of heaters such as, for example, five (5) heaters. Respective resistances may be measured for any number of individual heaters. Additionally or alternatively, resistances may be measured for any number of groups of heaters or strings of heaters.

Once the resistance of one or more heaters or one or more groups of heaters has been measured or determined at block 305, the method 300 continues at block 310. At block 310, the one or more resistance values may be stored in one or more suitable memory devices such as, for example, a memory located in the printer and/or a memory located in the print head or supply item (e.g. an ink tank). Additionally, an average resistance value may be stored in one or more suitable memory devices. It will be appreciated that the resistance of one or more heaters or one or more groups of heaters may be determined prior to the installation of a print head, such as 115, into a printing device, such as printer 100. In such a situation, the one or more resistance values and/or an average resistance value may be stored in a suitable memory device of the print head and accessed during and/or after the installation of the print head into a printing device.

At block 315, an average resistance value may optionally be determined if more than one resistance value has been determined. The determined average resistance value may also be stored in one or more suitable memory devices.

At block 320, a fire pulse value or range of fire pulse values may be determined based at least in part on the determined resistance value or determined average resistance value. For purposes of this disclosure, the term "fire pulse value" can refer to the duration of a fire pulse that is utilized to actuate a print head heater. According to an embodiment of the invention, one or more fire pulse values and/or ranges of fire pulse values may be stored in one or more suitable memory devices such as, for example, the memory of a printer 100 or a memory of a print head or supply item. The one or more fire pulse values and/or ranges of fire pulse values may be accessed from memory and a fire pulse value or range of fire pulse values may be selected based at least in part on the determined resistance value or determined average resistance value. In some embodiments of the invention, one or more fire pulse tables may be stored in a memory of a printer, such as memory 130. A fire pulse table may store one or more fire pulse widths or durations that are diverse enough in size to cover the full range of print head heater resistances, and other variables, which may affect the ejection of an ink droplet. The fire pulse table may be accessed and a fire pulse value or range of fire pulse values may be selected based at least in part on a determined resistance value or average resistance value.

At optional block 325, an ink drop velocity optimization (VO) procedure may be executed utilizing the determined fire pulse value or range of fire pulse values as an input. As used herein, the terms "ink drop velocity optimization procedure" and "velocity optimization procedure" can be used interchangeably. The VO procedure may repeatedly print a pattern using different fire pulses, and then scan the pattern to determine which of the fire pulses will deliver the optimal energy to the print head nozzles, such as nozzles 215A-N. According to various embodiments of the invention, the fire pulses used during the VO procedure may be determined based at least in part on the measured heater resistance. One or more fire pulse tables may be stored in a suitable memory, such as memory 130, and one or more specific tables may be utilized in the VO procedure based at least in part on the measured heater resistance. Accordingly, the range of fire pulses utilized during a VO procedure may be decreased and greater accuracy may be achieved in identifying an optimal fire pulse.

A typical VO procedure may print a predetermined number of patterns in order to select an optimal fire pulse. The number of printed patterns may be reduced by utilizing a smaller range of fire pulses that is selected based on the measured heater resistance, thereby decreasing the amount of ink utilized in the VO procedure and providing more usable space on a printer alignment page. For example, if a printer typically utilizes a lire pulse range of 300 nanoseconds (ns) over six printed patterns, the number of printed patterns may be reduced by narrowing the fire pulse range without sacrificing accuracy. By limiting, for example, the fire pulse range to 150 nanoseconds (ns) utilizing the measured heater resistance, the same precision may be achieved utilizing only three printed patters. Alternatively, more precision may be obtained by utilizing a smaller range of fire pulses. For example, if the VO procedure utilizes the same number of printed patterns, then smaller fire pulse increments may be utilized in the testing and greater accuracy may be achieved.

At optional block 330, an optimal fire pulse or optimum fire pulse value may be selected based at least in part on the results or output of the VO procedure, as will be understood by those of skill in the art. Examples of VO procedures are described in U.S. Pat. No. 6,629,747, entitled "Method for Determining Ink Drop Velocity of Carrier-Mounted Printhead," U.S. Pat. No. 6,669,324, entitled "Method and Apparatus for Optimizing a Relationship Between Fire Energy and Drop Velocity in an Imaging Device," U.S. Pat. No. 6,880,909, entitled "Method and Apparatus for Adjusting Drop Velocity," and U.S. Pat. No. 7,156,483, entitled "Method for Determining Ink Drop Velocity of Carrier-Mounted Printhead Using an Optical Scanner."

It will be appreciated that the operations described above with reference to FIG. 3 do, not necessarily have to be performed in the order set forth in FIG. 3, but instead may be performed in any suitable order. Additionally, it will be understood that, in certain embodiments of the invention, more or less than all of the operations set forth in FIG. 3 may be performed.

An example of the output of one pattern of an ink droplet velocity optimization procedure is depicted in FIG. 4. As shown in FIG. 4, a printer, such as printer 1100, may repeatedly print a pattern using different fire pulses. In FIG. 4, a first pattern 400 is printed using a first fire pulse (illustrated in FIG. 4 as a fire pulse having a duration of "X" nanoseconds). The first fire pulse may be, for example, a fire pulse that is selected utilizing a determined resistance of the print head heaters. Then, additional patterns 402, 404, 406 may be printed utilizing incremental fire pulse values. As shown in FIG. 4, a second pattern 402 may be printed utilizing a fire pulse value that is approximately 50 nanoseconds shorter than the first fire pulse value, a third pattern 404 may be printed utilizing a fire pulse value that is approximately 100 nanoseconds shorter than the first fire pulse value, and a fourth pattern 406 may be printed utilizing a fire pulse value that is approximately 150 nanoseconds shorter than the first fire pulse value. It will be appreciated that the patterns 400, 402, 404, 406 depicted in FIG. 4 are merely examples of patterns that may be printed as part of a VO procedure. Following the printing of one or more patterns, the patterns may be scanned in accordance with the VO procedure and an optimal fire pulse value may be determined.

According to certain embodiments of the invention, one or more print head heater resistance values may be determined prior to or during the print head being installed in a printer or other imaging system. For example, one or more resistance values may be determined prior to the print head being shipped from a manufacturing facility. It will be appreciated that a heater inspection string may be tested during a quality control phase of print head manufacture. During such testing, the resistances of one or more print head heaters may be determined. The one or more resistance values may be stored in a suitable memory location in a print head, such as in memory 230, and the one or more resistance values may be communicated to a printer, such as printer 100, in order to determine an optimal fire pulse and/or execute a VO procedure.

According to some embodiments of the invention, a printer or other imaging system, such as printer 100, may measure the heater resistance via a print head inspection string. A print head inspection string may include a plurality of print head heaters that are connected in series on a print head, such as print head 115. Any number of print head heaters may be included in an inspection string such as, for example, five (5) heaters. The inspection string may be accessed and measured by appropriate circuitry and associated control logic of the printer 100 when the print head 115 is installed.

It will be appreciated that the measurement of print head heater resistance may add another level of communication between a printer and a print head. The measurement of heater resistance through an inspection string may add another test or step to perform when a print head is installed. It will be appreciated that relatively few, if any, additional parts may be needed in a printer to accommodate the reading of heater resistance via an inspection string. For example, the heater resistance may be measured by the same or slightly modified circuitry and/or firmware that a printer may use to measure print head temperature.

The addition of another level of communication between a printer and a print head, such as printer 100 and print head 115, may help avoid poor quality printing and/or damage to the printer. For example, if a printer is unable to measure heater resistance or if a measured heater resistance is outside of a print head's specifications, then the printer may prevent the print head from being utilized in the printer.

A fire pulse table utilized in a VO procedure in accordance with an embodiment of the invention may be determined based at least in part on any calculations or formula that are based at least in part one the measured inspection string resistance value. For example, a fire pulse table may be selected based directly on the inspection string resistance value. As another example, further calculations may be performed in order to determine the individual resistances of the heaters in the inspection string and a fire pulse table may be selected based at least in part on the determined individual resistances.

Once a print head, such as print head 115, is installed and used in a printer, such as printer 100, the resistance associated with one or more of the print head heaters, such as heaters 220A-N, may change over the lifetime of the print head 115 due to impact ionization. For example, if field-effect transistors are utilized to turn the heaters on and off, then the resistance of a field-effect transistor (FET) may change over the lifetime of the print head 115 as the heaters are fired a relatively large number of times. Impact ionization may occur during the turn on/off of the power FET, thereby leading to an increase in the resistance of the FET. For example, if a transistor uses a relatively large drain to source voltage and a relatively low gate voltage when switching, then an electric field may be generated that causes electrons to gain enough kinetic energy to form electron-hole pairs by collisions with the atoms in the transistor channel. Over time, a charge may build up at the edges of the transistor gate, effectively pinching off the channel to some degree and reducing the area through which current can flow. The reduction in channel area may lead to an increase in resistance. Although field-effect transistors are described above, it will be appreciated that other types of transistors may be utilized in association with print head heaters and that the resistance of those transistors may also change over the lifetime of the print head.

FIGS. 5A and 5B are charts that illustrate example changes in the resistance of print head heater elements and associated transistors over the lifetime of the print head. FIG. 5A illustrates one example of measured changes in the resistance of a heater and associated FET. Similarly, FIG. 5B illustrates another example of measured changes in the resistance of a heater and associated FET. In FIG. 5A, a situation is illustrated in which the resistance of both the heater and the associated FET increase over the lifetime of the print head. In FIG. 5B, a situation is illustrated in which the resistance of the heater decreases over the lifetime of the print head while the resistance of the FET increases over the lifetime of the print head. FIGS. 5A and 5B plot the percentage change in the resistance as a heater is fired up to about 100 million times, and illustrate both the percentage change in resistance of the combination of the heater and its associated FET and the percentage change in resistance of the heater alone. As shown in FIGS. 5A and 5B, the change in the total resistance of a heater and associated FET may be on the order of approximately five to six percent as a heater is fired up to about 100 million times.

Due to changes in the resistance of print head heaters over the lifetime of the printer, it will be appreciated that the fire pulse selected during a VO procedure that is implemented during the initialization of a print head may not remain the optimum fire pulse over the lifetime of the print head. In other words, as the heaters are fired over the life time of the print head, the optimal fire pulse value may change.

According to certain embodiments of the invention, an optimal fire pulse for a print head, such as print head 115, may be determined multiple times during the lifetime of the print head 115. Rather than only determining a fire pulse value when a print head 115 is installed and using the fire pulse value during the lifetime of the print head 115, an optimal fire pulse may be determined whenever one or more test conditions have been satisfied. For example, an optimal fire pulse may be determined whenever a new ink cartridge or ink supply is installed and/or whenever the heaters of a print head have been fired a predetermined number of times. Alternatively, rather than recalculating an optimal fire pulse, the fire pulse may be adjusted over the lifetime of the print head 115 whenever one or more test conditions have been satisfied such as, for example, when the print head heaters have been fired a predetermined number of times.

FIG. 6 depicts a flowchart of a method 600 for adjusting the optimum fire pulse value over the course of the lifetime of the print head, accordance to an illustrative embodiment of the invention. The method 600 begins at block 605. At block 605, an optimum fire pulse may be determined for a print head, such as print head 115, when the print head 115 is installed in a printer or imaging device, such as printer 100. The methodology utilized to determine the optimum fire pulse at installation may be similar to that depicted in FIG. 3.

At block 610, the print head 115 may be monitored during its lifetime. The print head 115 may be monitored for one or more test conditions that, if identified and/or met, may trigger an adjustment to the optimum fire pulse value. It will be appreciated that a wide variety of test conditions may be identified. These tests conditions may include for example, the identification of a total number of ink droplets that have been ejected by the print head 115, the identification of a number of ink droplets that has been ejected since the last determination of an optimum fire pulse value, the identification of a total number of fires of the heaters of the print head, the identification of a number of fires of the heaters of the print head since the last determination of an optimum fire pulse value, the identification of the passage of a predetermined period of time since the last determination of an optimal fire pulse value, and/or the installation of one or more new ink cartridges or ink supplies. The test conditions may be predetermined test conditions that are stored by a suitable controller, such as the print head controller 205 or printer controller 105. It will be appreciated that various counters may be utilized as desired to track the operation of the print head 115 and determine when a test condition has been satisfied.

It will also be appreciated that a wide variety of different values may be utilized to establish test conditions. For example, a wide variety of values may be utilized to establish a number of ink droplet ejections and/or heater actuations that should occur prior to recalculating and/or adjusting an optimum fire pulse value. For example, the optimum fire pulse value may be reevaluated or adjusted at approximately every 10 million or approximately every 20 million heater actuations.

At block 615, a determination may be made as to whether a predetermined test condition has been met. If a predetermined test condition has not been satisfied, then the method 600 continues at block 610 and the print head 115 may continue to be monitored. If one or more predetermined test conditions have been satisfied, then the method 600 continues at block 620.

At block 620, a new determination of the optimum fire pulse value may be made and/or the optimum fire pulse value may be adjusted based at least in part on the test condition that has been satisfied. According to certain embodiments of the invention, the optimum fire pulse value may be adjusted based on the satisfied test condition. In other words, the optimum fire pulse may be adjusted by a predetermined value or in accordance with a predetermined algorithm once a test condition has been satisfied. For example, the fire pulse may be increased by a predetermined time duration based on the number of ink droplets that has ejected by the print head 115 and an expected resistance change based upon the number of ejected ink droplets. As another example, the fire pulse may be increased by a predetermined time duration based on the number of heater actuations or activations by the print head 115 and an expected resistance change based upon the number of heater actuations. It will be appreciated that such an adjustment may be a continuous adjustment throughout the lifespan of the print head 115. For example, the fire pulse duration may be increased by approximately 20 ns for every 10 million ink droplet ejections and/or heater actuations. If the optimum fire pulse is adjusted based upon the satisfied test condition, there may be no need to run a VO procedure printer multiple times over the life cycle of the print head 115.

The method 600 may continue to monitor the print head 115 as desired. It will be appreciated that the method 600 may end and/or restart if an error is detected in the print head 115 or if a new print bead is installed.

It will be appreciated that the operations described above with reference to FIG. 6 do not necessarily have to be performed in the order set forth in FIG. 6, but instead may be performed in any suitable order. Additionally, it will be understood that, in certain embodiments of the invention, more or less than all of the operations set forth in FIG. 6 may be performed.

According to certain embodiments of the invention, a velocity optimization procedure may be executed several times over the lifespan of the print head 115 such as, for example, when a test condition has been satisfied. The VO procedure may be utilized to determine an optimum fire pulse value at multiple times over the life span of the printer based at least in part on changes in the heater resistance. Additionally, the one or more fire pulse tables that are utilized by the VO procedure may be selected based at least in part on the satisfied test condition or other variables associated with the print head 115. In other words, multiple fire pulse tables may be stored in a suitable memory device and an appropriate table or set of tables may be selected based at least in part on the satisfied test condition or other variables associated with the print head 115. For example, the one or more fire pulse tables that are utilized may be selected based upon the total number of ejected ink droplets, the number of ejected ink droplets since the last time that a VO procedure has been executed, the total number of heater actuations, and/or the number of heater actuations since the last time that a VO procedure has been executed. It will be appreciated that one or more fire pulse tables may be selected based upon appropriate variables associated with the print head 115 such as, for example, the total number of ejected ink droplets, regardless of the test condition that has been satisfied. For example, if a new ink cartridge is installed and a VO procedure is executed, then one or more fire pulse tables utilized in the VO procedure may be selected based upon one or more appropriate variables such as, for example, the ink droplet ejection count for the print head 115.

As an illustrative example of adjusting the optimum fire pulse based upon the ink droplet ejection count, a VO procedure may be executed when a print head is installed and the fire pulse table that is utilized may test a first range of fire pulse values with durations from approximately 300 ns to approximately 600 ns. Once approximately 10 million ink droplets have been ejected by the print head, a VO procedure may be executed with a fire pulse table that tests a second range of fire pulse values with durations from approximately 350 ns to approximately 650 ns. Once approximately 20 million ink droplets have been ejected by the print head, a VO procedure may be executed with a first pulse table that tests a third range of fire pulse values with durations from approximately 400 ns to approximately 700 ns, and so forth.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The claimed invention is:

1. A method for optimizing the fire energy supplied to an actuator of a print head, comprising:

determining a resistance associated with the actuator;

determining one or more fire pulse values based at least in part on the determined resistance;

executing a velocity optimization procedure based at least in part on the determined one or more fire pulse values; and selecting an optimal fire pulse for the actuator based at least in part on an output associated with the velocity optimization procedure.

2. The method of claim 1, wherein determining the resistance comprises:

determining a respective resistance associated with each of a plurality of actuators of the print head; and determining an average resistance based at least in part on the plurality of respective resistances.

3. The method of claim 1, wherein determining the resistance comprises at least one of measuring the resistance of the actuator or reading the resistance from at least one memory associated the print head.

4. The method of claim 1, wherein determining one or more fire pulse values comprises:

accessing a plurality of fire pulse tables comprising respective fire pulse values; and selecting at least one fire pulse table based at least in part on the determined resistance.

5. The method of claim 1, further comprising:

ejecting ink from a nozzle of the print head by activating the actuator at least once subsequent to executing the velocity optimization procedure; and determining a new optimum fire pulse for the actuator.

6. The method of claim 5, wherein determining the new optimum fire pulse comprises:

determining a total number of activations associated with the actuator; and determining the new optimum fire pulse based at least in part on the determined total number of activations.

7. The method of claim 5, wherein the one or more fire pulse values are a first set of fire pulse values, wherein the velocity optimization procedure is a first velocity optimization procedure, and wherein determining the new optimum fire pulse comprises:

determining a total number of activations associated with the actuator;

determining a second set of one or more fire pulse values based at least in part on the determined total number of activations;

executing a second velocity optimization procedure based at least in part on the determined second set of fire pulse values; and selecting the new optimal fire pulse for the actuator based at least in part on an output association with the second velocity optimization procedure.

8. A system for optimizing a fire pulse supplied to an actuator of a print head, comprising:

a resistance measuring device operable to determine a resistance associated with the actuator; and at least one controller operable to (i) determine one or more fire pulse values based at least in part on the determined resistance, (ii) facilitate the execution a velocity optimization procedure based at least in part on the determined one or more fire pulse values, and (iii) select an optimal fire pulse for the actuator based at least in part on an output associated with the velocity optimization procedure.

9. The system of claim 8, wherein the at least one controller is further operable to (i) determine a respective resistance associated with each of a plurality of actuators, and (ii) determine an average resistance based upon the plurality of respective resistances, wherein the average resistance is utilized to determine the one or more fire pulse values.

10. The system of claim 8, wherein the resistance measuring device comprises a circuit configured to measure the resistance of the actuator.

11. The system of claim 10, wherein the circuit is remotely located to the print head.

12. The system of claim 8, wherein the at least one controller is operable to determine the one or more fire pulse values by accessing a plurality of fire pulse tables comprising one or more fire pulse values, and to select at least one fire pulse table based at least in part on the determined resistance.

13. The system of claim 8, wherein the at least one controller is further operable to direct, subsequent to the execution of the velocity optimization procedure, the activation of the actuator at least once to facilitate ejection of ink from a print head nozzle associated with the actuator, and to determine, subsequent to the at least one activation, a new optimum fire pulse for the actuator.

14. The system of claim 13, wherein the at least one controller is further operable to determine a total number of activations associated with the actuator and to determine the new optimum fire pulse based at least in part on the determined total number of activations.

15. The system of claim 13, wherein the one or more fire pulse values comprise a first range of fire pulse values, wherein the velocity optimization procedure is a first velocity optimization procedure, and wherein the controller is further configured to (i) determine a total number of activations associated with the actuator, (ii) determine a second range of fire pulse values based at least in part on the determined total number of activations, (iii) instruct the execution of a second velocity optimization procedure based at least in part on the determined second range of fire pulse values, and (iv) select the new optimal fire pulse for the actuator based at least in part on an output associated with the second velocity optimization procedure.

16. A print head, comprising:

a plurality of nozzles and a plurality of associated actuators, wherein the activation of at least one of the plurality of actuators facilitates ejection of ink from at least one of the plurality of nozzles; and a memory;

wherein at least one variable associated with a velocity optimization procedure is stored in said memory.

17. The print head of claim 16, wherein the variable comprises at least of a portion of a fire pulse table.

18. The print head of claim 16, wherein the variable comprises an ink droplet ejection count.

19. The print head of claim 16, wherein the variable comprises a heater inspection string for one or more heaters.

20. The print head of claim 16, wherein the variable comprises a value representing a measured resistance of one or more heaters.

* * * * *